US006528185B2

(12) United States Patent
Man et al.

(10) Patent No.: US 6,528,185 B2
(45) Date of Patent: Mar. 4, 2003

(54) COBALT-TUNGSTEN-PHOSPHORUS ALLOY DIFFUSION BARRIER COATINGS, METHODS FOR THEIR PREPARATION, AND THEIR USE IN PLATED ARTICLES

(75) Inventors: Hau-chung Man, Kowloon (HK); Wing-yan Ng, Kowloon (HK); Chi-hung Yeung, Kowloon (HK); Chi-yung Lee, Kowloon (HK); Cho-lung Siu, Kowloon (HK); Rick Y. C. Tsui, Kowloon (HK); Kinny L. K. Yeung, Kowloon (HK)

(73) Assignees: Hong Kong Polytechnic University, Kowloon (HK); Hong Kong Productivity Council, Kowloon (HK)

( * ) Notice: Subject to any disclaimer, the term of this patent is extended or adjusted under 35 U.S.C. 154(b) by 66 days.

(21) Appl. No.: 09/794,395

(22) Filed: Feb. 28, 2001

(65) Prior Publication Data

US 2002/0160222 A1 Oct. 31, 2002

(51) Int. Cl.[7] ..... B32B 15/01; C25C 3/12

(52) U.S. Cl. ..... 428/675; 428/672; 428/935; 205/176; 205/258

(58) Field of Search ..... 428/668, 675, 428/672, 935, 936; 427/437; 205/176, 255, 258

(56) References Cited

U.S. PATENT DOCUMENTS

| | | | | | |
|---|---|---|---|---|---|
| 5,484,494 | A | * | 1/1996 | Oda et al. | 148/561 |
| 5,523,174 | A | * | 6/1996 | Tamaki | 427/436 |
| 5,614,003 | A | * | 3/1997 | Mallory, Jr. | 106/1.22 |
| 5,695,810 | A | * | 12/1997 | Dubin et al. | 427/437 |
| 6,153,935 | A | * | 11/2000 | Edelstein et al. | 257/276 |
| 6,323,128 | B1 | * | 11/2001 | Sambucetti et al. | 205/238 |
| 2000/0019892 | | * | 9/2001 | Komai et al. | 438/687 |

* cited by examiner

*Primary Examiner*—John J. Zimmerman
(74) *Attorney, Agent, or Firm*—Leydig, Voit & Mayer, Ltd.

(57) ABSTRACT

Techniques are provided for electrolessly depositing and electrodepositing CoWP barrier coating onto copper or copper alloys to prevent copper diffusion when forming layers on articles such as watch bracelets, watch cases, imitation jewelry, spectacle frames and metal buttons.

8 Claims, 1 Drawing Sheet

COBALT-TUNGSTEN-PHOSPHORUS ALLOY DIFFUSION BARRIER COATINGS, METHODS FOR THEIR PREPARATION, AND THEIR USE IN PLATED ARTICLES

BACKGROUND OF THE INVENTION

I. Field of the Invention

This invention generally relates to the prevention of migration of basis metal to overplate.

II. Description of the Prior Art

Deposition of gold on copper and its alloys can be accomplished satisfactorily by plating a diffusion barrier coating between the basis metal and the overplate. Without the barrier, copper in the basis metal dissolves in the gold layer and quickly migrates to the surface, even at room temperatures. On exposure to air, the copper atoms on the surface of gold layer can be easily oxidized to form black oxides. Many consumer articles such as watch bracelets, watch cases, imitation jewellery and spectacle frames are plated with gold. The presence of these black copper oxides destroys the aesthetic appearance of gold coating used as decorative purpose.

A number of materials are known for forming diffusion barriers for copper. They include Ni, Co, Pd, W, Mo and other high melting points metals. These materials can be deposited singly or co-deposited on copper by conventional methods such as electroplating, electroless deposition, physical vapor deposition (PVD) or chemical vapor deposition (CVP). This coating is initially deposited on the copper/copper alloy basis metal intended as diffusion barrier coating. The decorative gold overplate is then plated on the diffusion barrier, achieving the goal to impede the migration of copper atoms to the gold plating.

Ni has been used extensively as the diffusion barrier material for copper for the manufacturing of consumer products. However, Ni suffers the drawback on its relative case of corrosion when used in consumers articles. These articles are worn with prolonged contact with the human skin. Perspiration secreted from the skin contains sodium chloride, among other components, deposits on the article during prolonged contact. The perspiration migrates through the pores of the gold overplate to the Ni under coating and corrodes the metallic Ni diffusion barrier to Ni(II) state. The nickel ion dissolves easily in the perspiration and migrates back to the outer gold coating of the article.

Ni(II) ion is known to irritate human skin and causes sensitization of humans skin to nickel, leading to allergic reactions (see for example, "Metall als Allergen", R. Breitstadt; Galvanotechnik, vol. 47, no. 1; 1993; pp.-16–19). These findings revealed from detail studies on the allergic reactions on human skin (see for example, "Reinst-Palladium als Ersatz fur Palladium/Nickel. Einsatz fur Endschichten und als Diffusionssperre", K. -P. Beck, Glavanotechnik, vol. 47, no. 1; 1993; pp.20–22) have initiated the issuance of the Directive 76/769/EEC in 1994 controlling the use of Ni in consumer articles and the liberation of Ni(II) ions (see for example, "Control of nickel emission in jewellery and related items", R. V. Green and J. F. Sargent, Transactions of the Institute of Metal Finishing, vol. 75, no.3; 1997; p. B51–52). In essence, metal objects with the intent for prolonged contact with human skin and are made of nickel-containing alloys or coated with nickel-containing substances, should not release nickel in excess of $0.5\mu g/cm^2$/week. The specifications for monitoring the said release rate are documented in the standards, EN1811 and EN12471 adopted by the European Committee for Standardization (CEN) in late 1999.

Accordingly, the present invention describes a technique of utilizing a ternary alloy coating of Co, W and P deposited either with electroplating and electroless plating techniques to form an efficient barrier to reduce the migration of copper.

SUMMARY OF THE INVENTION

The present invention describes a technique of depositing CoWP coating with either electroplating or electroless plating method on copper or copper alloy. Gold or gold alloy will subsequently plate on the ternary alloy coating. The purpose of the ternary alloy coating is to form a diffusion barrier reducing the migration of copper to the gold top coating. Coatings formed with either technique gives a mixture of amorphous-microcrystalline structure, thus enhancing both barrier and corrosion resistant properties. Electroplating furnishes a rapid technique in yielding an efficient coating. Electroless deposition process does not require the use of electric current. Good coverage is an additional benefit with this plating technique.

DETAILED DESCRIPTION OF THE PREFERRED EMBODIMENTS

Figure 1:
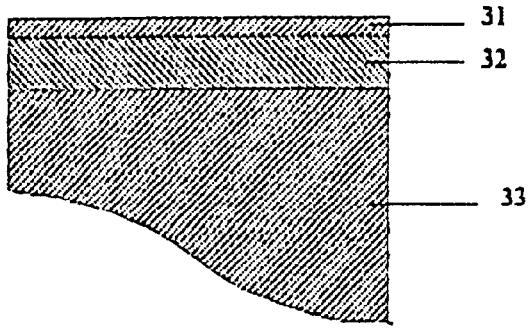
FIG. 1 is a schematic side sectional view of a coated substrate.

Fashion ornamental articles such as imitation jewellery, watch cases and bracelets etc. are made with brass and other copper alloys. Elegant and attractive designs for these fashion goods can be fabricated with these malleable metals with minimal investment in precision machine tools. These fashion goods are often coated with decorative gold and gold alloy coatings to impart their full attractiveness, and yet manufactured at minimal costs. Electroplating of gold and gold alloys as decorative coatings are usually carried out with electroplating and PVD. The science and technology of gold electroplating have been well developed and documented (see for example, "Gold Plating Technology", F. H. Reid and W. Goldie, Electrochemical Publications Ltd., Ayr, Scotland, 1974). However, it is undesirable to plate gold and its alloys directly on copper and its alloys. When gold and copper are in intimate contact with each other a solid solution of these metals can be formed easily at the junction. These metals can quickly migrate into each other even at room temperatures. When copper atoms diffuse onto the top surface of the gold overplating it can be oxidized by air to form colored copper oxides. For decorative purposes, the presence of copper oxides on the surface supersedes the lustrous gold appearance. To overcome this problem, a thin barrier layer is coated between the basis metal and the gold overplate. The function of the barrier layer is to separate copper from gold and to impede the migratory process of copper atoms into gold. Typical metals used as copper barrier are nickel, cobalt, palladium, copper-tin alloys etc. (see for example, "Alternatives for nickel in electroplating processes", F. Simon, Transactions of the Institute of Metal Finishing, vol. 73, no.3; 1997; p.B53–56). The choice of the most appropriate barrier is based on the transport property of copper in it, corrosion resistance property with human perspiration, allergic property of its corroded products, and its physical property during fabrication. The use of nickel for articles with prolonged contact with the human skin has been controlled in EEC countries.

Palladium has been used as the substitute for nickel-free barrier coating, but the spiralling costs for palladium has put it in a disadvantaged position for its popularity. Copper-tin alloy though an effective barrier at room temperatures poses unfavorable manufacturing conditions at high temperatures.

Cobalt, though it is a superior copper barrier, can be attacked by human perspiration easily in its pure state. When alloyed with W or Mo and P, the corrosion resisting property of cobalt is very much improved.

It is to be appreciated that the barrier layer should be hard in order to resist abrasion, amorphous to impede copper migration and resist corrosion, and not sublime at high vacuum and temperature.

High melting metals are known to form effective diffusion barriers, impeding the migration of copper. W is one of the high melting metals that satisfies the criteria as an efficient barrier. However, it cannot be deposited as the pure metal by electrolysis in aqueous solution because of its high hydrogen overpotential. W can only be deposited in the presence of an element of the iron group to form alloys, as described in the excellent work "Electrodeposition of Alloys. Principles and Practice. Vol. 1."; Abner Brenner, 1963, Academic Press, NY.

W—Co, W—Ni and W—Fe alloys possesses outstanding properties, including barrier for copper (see for example, "Cobalt and Its Alloys as Potential Replacements for Palladium as Barrier Coatings for Copper/Brass Base Metals", Wing-yan Ng et al, Asian Industrial Technology Congress '99, 26–29 Apr., 1999, Paper NM-C8-1). The solubility of Cu in Co at low temperatures in the solid solution state is very low. This gives the alloy an additional premium on its barrier property.

It is known that amorphous binary alloys of W and Co are obtained from electrolysis with W/(W+Co) ionic ratio higher than ½in the plating baths (see, for example, "Interdiffusion of Cu substrate/electrodeposits for Cu/Co, Cu/Co—W, Cu/Co—Ni and Cu/Co—W/Ni systems", K. M. Chow, W. Y. Ng and L. K. Yeung, Surface and Coatings Technology, vol.99, 1998, pl161–170). The incorporation of a small amount of P in CoW enhances the formation of amorphous ternary CoWP alloy, reducing the amount of grain boundaries of the coating at crystalline state. It also reduces copper migration and increases the corrosion resisting property of the alloy. Further teaching in relation to the use of COWP alloys in semiconductor and other technologies is to be found, for example, in U.S. Pat. No. 5,695,810 (Dubin at al.); U.S. Pat. No. 5,614,003 (Mallory, Jr.); U.S. Pat. No. 5,523,174 (Tamaki et al.); GB 1,203,195 (Blanchard); and U.S. Pat. No. 3,963,455 (Ostrow et al.).

The presence of W and P in the coating inhibits corrosion of Co in the alloy coating. The ternary CoWP coating resists corrosion caused by perspiration on prolonged contact with human skin. The inhibition action is initiated from the reaction of W with air, forming a passive film on the ternary alloy coating. The thickness of the passive film increases with time and temperature on exposure with air. One hour is normally required to fully develop the passive film at room temperatures.

CoWP can be deposited on copper or copper alloy using the electroless technique or by electroplating.

Electroless plating has the advantage that the coating process does not depend on the application of electric current. The thickness of the coating is independent of the geometry of the workpiece. Suitably for electroless deposition, the primary metal is cobalt. Thus, wherein the secondary metal is tungsten and the ternary alloy produced contains phosphorus. The electroless plating bath is typically maintained at a pH range of from about 7.5 to about 11, preferably about 8 to about 10. The bath is usually maintained at a temperature range from about 75° C. to about 95° C., preferably about 85° C. to about 95° C. Plating additives such as organic acid ions or other compounds can usefully be included in the bath; such as sodium citrate within the range of from about 20 g/l to about 50 g/l , preferably within the range of from about 28 g/l to about 38 g/l; succinic acid within the range of from about 25 g/l to about 60 g/l, preferably within the range of from about 35 g/l to about 45 g/l; lactic acid within the range of from about 3 g/l to about 7 g/l; phenyl thiourea within the range of from about 0.2 mg/l to about 1.5 mg/l, preferably within the range of from about 0.4 mg/l to about 1.2 mg/l; or malic acid is present in the bath within the range of from about 25 g/l to about 35 g/l.

With electrodepositing, the primary metal is suitably cobalt, the secondary metal is tungsten and the ternary alloy produced contains phosphorus. The plating bath is typically maintained at a pH range of from about 7.5 to about 11, preferably from about 8 to about 10. Usually the bath is maintained at a temperature range of from about 55° C. to about 70° C., preferably from about 60° C. to about 65° C. Plating additives such as organic acid ions or other compounds can usefully be included in the bath; such as sodium citrate within the range of from about 15 g/l to about 40 g/l, preferably within the range of from about 21 g/l to about 31 g/l; or succinic acid within the range of from about 2 g/l to about 7 g/l, preferably within the range of from about 3 g/l to about 5 g/l. In one preferred embodiment, the anode compartment is separated from the cathode compartment with cationic or bipolar exchange membrane to reduce oxidation of citrate or other ion at the anode.

The structure produced by the present invention is illustrated in FIG. 1. A coating of an amorphous-microcrystalline alloy 32 of CoWP is deposited electrolytically or electrolessly onto the surface of a substrate 33. The coating 32 impedes the migration of copper atoms to the top decorative gold or gold alloy coating 31.

Figure 2:
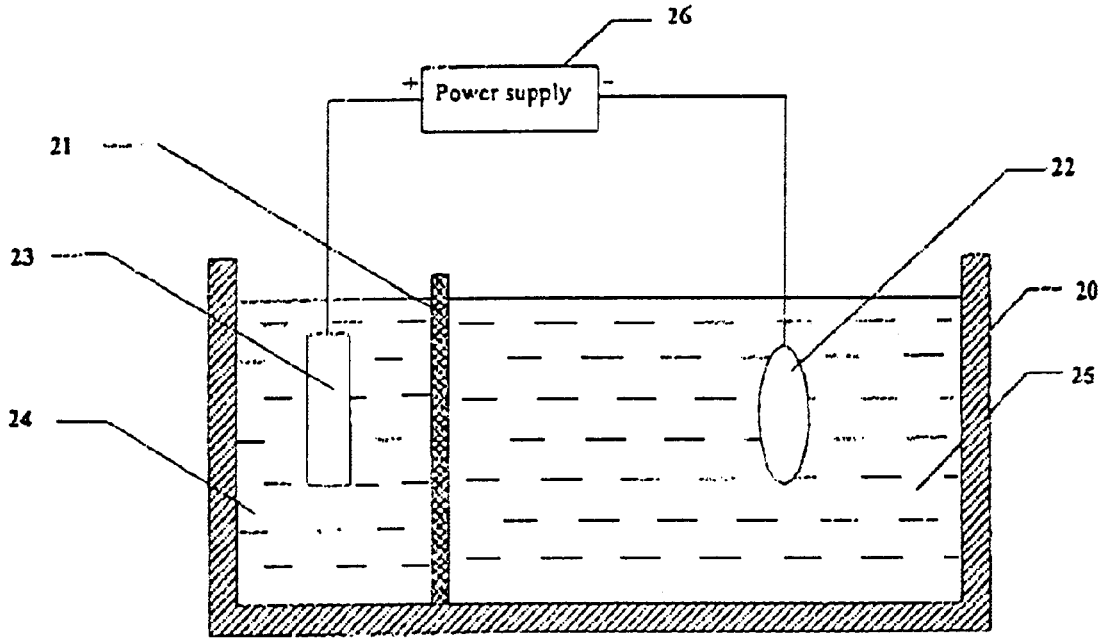
FIG. 2 is a schematic illustration of a preferred electrodeposition apparatus for conducting the process of the invention.

As illustrated in FIG. 2, for an electrodeposition process the anode 23 is an inert electrode such as platinized titanium gauze, which is not consumed during electrolysis. Electrodeposition is accomplished in a tank 20. The tank is divided into the anode and cathode compartments. The cathode compartment is sufficiently large to hold a quantity of an electrodeposition bath 25 containing the elements to be co-deposited. The workpiece 22 is connected to the negative polarity of a power supply unit 26. The anode compartment contains a conducting bath 24 such as ammonium, sodium or potassium sulfate solution, or a mixture of these ingredients, of approximately 200 g/l.

The anode and cathode compartments are separated with an ion-exchanged membrane 21 such as Nafion 117 or BIMI bi-polar membrane.

For electroless plating, the workpiece is usually activated with palladium. The basis metal, which is copper, is immersed in a very weak solution of acidified palladium chloride of 0.05 g/l. Copper displaces palladium ions to form active catalytic sites on the workpiece to further electroless plating processes.

Deposition activation for electroless plating of the ternary alloy, CoWP, can also be initiated by copper atom on the basis metal. However, the palladium contact displacement method is normally preferred in order to maintain consistent quality throughout the deposition process.

It is appreciated that electroless deposition solutions can be formulated to deposit CoWP coating from suitable combinations of different concentrations of Co and W compounds, preferably cobalt sulfate and alkali metal tungstate, coupled with a hypophosphite as the reducing agent. Co is chelated with a hydrocarboxylic acid to enable the metal to remain in solution even when the plating solution is kept at pH values higher than 7. Citric acid has been found to be one of the best among the common hydrocarboxylic acids used in electroless plating. During the reduction process, W is deposited in the presence of Co. P is released from hypophosphite and is included in the alloy to form stable amorphous film.

In general, electroless deposition rate of a typical formulation comprising of 35g/l $CoSO_4 7H_2O$, 35g/l citric acid, 20g/l $Na_2WO_4.2H_2O$, maintained at 80°–90° C. and at a pH 8–10 is 1.5–2 microns per hour. A barrier coating of 2-micron thickness of amorphous CoWP is of sufficient thickness to form an efficient barrier to impede the migration of copper at 400° C. for more than 48 hours.

The ternary alloy can also be deposited on the cathode in an electrolytic cell. DC current reduces Co, W and P of the above solution to form bright amorphous alloy film in current density of 0.2–6 A/dm$^2$ at 60°–70° C. At current densities lower than 0.1A/dm$^2$ only bright Co—P binary alloy is deposited. Palladium seeding is not required for activating the workpiece before plating.

Oxidized products formed from the organic ingredients at the anode in the plating bath interferes with the plating processes (see for example, "Electrochemical and chemical reactions in baths for plating amorphous alloys", J. Donten and J. J. Osteryoung, Journal of Applied Electrochemistry, vol. 21, 1991, p496–503). Anode oxidation of organic ingredient can be reduced with the addition of polarizable ingredients such as hydrazine, in the electroplating bath. Cobalt ions can be oxidized to the insoluble oxide of a higher oxidation state. However, it does not interfere with the overall electroplating processes of the ternary alloy.

The anodic oxidation processes of the electroplating ingredients of the above mentioned electroplating bath can be effectively reduced when the anode compartment of the electroplating bath is segregated from the cathode compartment with either an cationic ion exchange or bipolar ion exchange membrane. Referring to FIG. 2, the anode compartment 24 is segregated from the cathode compartment 25 with an cationic or bipolar exchange membrane 21. The cationic exchange membrane only allows cations to migrate through. The transport number of divalent ions such as $Co^{2+}$is of the order of 0.2 to cause minimal loss of cobalt ions from the cathode compartment to the anode compartment. The anode compartment contains a mixture of sodium and ammonium sulfate solution with concentrations of about the same strength for these ions in the cathode compartment. There is little or no migration of these cations across the ion exchange membrane during electrolysis. CoWP coatings formed from electroless and electrolytic techniques possess similar diffusion barrier and corrosion resisting properties. Passive films are formed slowly on these coatings on exposure to air. It is understood that overplates to be coated on these coatings in aqueous medium have to be proceeded before the formation of thick passive films.

EXAMPLE I

A cleaned brass bracelet was immersed in 0.05 g/l palladium chloride solution for 30 seconds. CoWP was electrolessly deposited at a thickness of about 2 microns in the following bath.

| | |
|---|---|
| $CoSO_4.7H_2O$ | 35 g/l |
| $Na_2WO_4.2H_2O$ | 33 g/l |
| Sodium citrate | 65 g/l |
| Sodium hypophosphite | 45 g/l |
| Ammonia solution | in sufficient amount to adjust the pH to 9. |

The plating bath was maintained at 85° C. under mild agitation for 60 minutes.

EXAMPLE II

A bracelet was pre-treated in similar way as in Example I. Succinic acid was added at 25 g/l in a bath of the saxne composition as above. A clean brass watch bracelet was immersed in the bath for 30 minutes at 85° with mild agitation followed with thorough rinsing. The plating rate was 2–3 microns per hour.

EXAMPLE III

A clean watch bracelet was plated in the same bath as described in Example II, with the addition of 1-phenylthiourea at 1ppm level. The bath was stabilized and the plating rate was increased by about 1 micron per hour.

EXAMPLE IV

Malic acid was added to the bath described in Example I at 30 g/l. The plating rate was increased by 1 micron per hour.

EXAMPLE V

A clean watch bracelet was plated in the same bath as described in Example III, with the addition of 5g/l of lactic acid. Plating was conducted at 85° C. and pH 9. The plating rate was increased 2 microns/hour.

EXAMPLE VI

A clean watch bracelet and a piece of platinized titanium gauze were immersed in the following bath:

| | |
|---|---|
| $CoSO_4.7H_2O$ | 10 g/l |
| $Na_2WO_4.2H_2O$ | 20 g/l |
| Sodium citrate | 26 g/l |
| Sodium hypophosphite | 18 g/l |
| Succinic acid | 4 g/l |
| Ammonia solution | in sufficient amount to adjust the pH to 9. |

A DC power source was connected to the bracelet and the platinized titanium gauze, with the negative polarity of the DC current connected to the bracelet at 2A/dm$^2$. The temperature was kept at 65° C. The anode compartment of the plating bath is separated from the cathode compartment with a cationic exchange membrane. Amorphous ternary alloy of CoWP was plated on the bracelet.

EXAMPLE VIII

A bracelet was plated in a bath in similar way as in Example VII. Bipolar exchange membrane was used instead. Amorphous ternary CoWP alloy was coated on the bracket.

We claim:

1. A method of replacing nickel as a barrier layer on copper for decorative coating processes for manufacturing plated articles in prolonged contact with human skin, comprising electrodepositing on copper and copper alloys a ternary amorphous-microcrystalline cobalt alloy of cobalt, tungsten, and phosphorus in an aqueous bath to achieve a barrier layer to impede the migration of copper atoms.

2. The method according to claim 1 wherein the cobalt alloy includes cobalt as a primary metal, tungsten as a secondary metal, and phosphorus.

3. The method according to claim 1 wherein the bath is maintained at a pH in the range of from about 8 to about 10.

4. The method according to claim 1 wherein the bath is maintained at a temperature in the range from about 60° C. to about 65° C.

5. The method according to claim 1 including a source of sodium citrate in the bath within a range of from about 21 g/l to about 31 g/l.

6. The method according to claim 1 including a source of succinic acid in the bath in a concentration within a range of from about 3 g/l to about 5 g/l.

7. The method according to claim 1 wherein an anode compartment is separated from a cathode compartment by a cationic or bipolar exchange membrane to reduce oxidation of citrate ion at the anode.

8. An imitation gold article selected from a watch bracelet, a watch case, an item of imitation jewellery, a pair of spectacle frames, and a metal button, said article having a copper surface coated with a cobalt-tungsten-phosphorus alloy and overplated with gold or a gold alloy.

* * * * *